US007703857B2

(12) United States Patent
Willison

(10) Patent No.: US 7,703,857 B2
(45) Date of Patent: Apr. 27, 2010

(54) CONTINUOUS MINER HAVING A SUMPING FRAME

(75) Inventor: John E. Willison, Cranberry, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 133 days.

(21) Appl. No.: 11/852,280

(22) Filed: Sep. 8, 2007

(65) Prior Publication Data

US 2009/0066148 A1 Mar. 12, 2009

(51) Int. Cl.
*E21C 35/00* (2006.01)

(52) U.S. Cl. ..... 299/65; 299/67

(58) Field of Classification Search ..... 299/65, 299/66, 67, 78

See application file for complete search history.

(56) References Cited

U.S. PATENT DOCUMENTS 3,860,291 A 1/1975 Rauch et al.
4,079,792 A * 3/1978 Paul et al. ..... 173/189
4,277,105 A 7/1981 Taylor
5,050,934 A 9/1991 Brandl et al.
5,333,936 A * 8/1994 Zitz ..... 299/64
2005/0156460 A1 * 7/2005 Brandl ..... 299/95

FOREIGN PATENT DOCUMENTS

WO WO-83/00525 2/1983

* cited by examiner

*Primary Examiner*—John Kreck
(74) *Attorney, Agent, or Firm*—James Earl Lowe, Jr.

(57) ABSTRACT

A continuous miner including a support frame having a support frame front, and a sumping frame mounted on the support frame for forward and rearward movement relative to the support frame. The sumping frame has a sumping frame front, and the miner further includes a cutting drum pivotally mounted on the sumping frame, the cutting drum being positioned near the sumping frame front. The miner also includes a gathering head for gathering mined minerals pivotally mounted on the sumping frame front, and a hydraulic cylinder for pivoting and fixing the gathering head relative to the sumping frame in both the raising and lowering directions. The continuous miner also includes a first drilling platform pivotally mounted on the support frame front, a second drilling platform pivotally mounted on the support frame front and spaced apart from the first drilling platform, a hydraulic cylinder for pivoting and fixing the first drilling platform relative to the support frame independently of the second drilling platform, and a hydraulic cylinder for pivoting and fixing the second drilling platform relative to the support frame independently of the first drilling platform.

5 Claims, 8 Drawing Sheets

CONTINUOUS MINER HAVING A SUMPING FRAME

BACKGROUND OF THE INVENTION

This invention relates to mining machines including a cutting drum mounted on a sumping frame, and more particularly, to such machines with mechanisms to improve the stability of the mining machine as the cutting drum sumps forward.

In the art of underground mining such as applied to the mining of coal from underground seams it is well known to mine solid mineral by providing mobile mining apparatus having mining head adapted by means of articulated mountings for dislodging the mineral in a substantially continuous manner. In practice such continuous mining operations often have comprised alternating sump and shear cutting cycles wherein the mining head is first actuated through a sump or horizontal cut into the mine face preparatory to a shear cut, and then through the shear or vertical cut across the face surface to dislodge mineral there from and to provide clearance for the advancing mining apparatus to pass. Subsequently the mining apparatus is trammed forward into the clearance cut by the mining head on tracks or the like to again position the apparatus adjacent the face surface for another sump and shear cutting sequence. Commonly, such continuous mining apparatus has also been adapted to automatically gather and load the mineral dislodged by the repeated cutting sequences into haulage means such as shuttle cars.

SUMMARY OF THE INVENTION

One of the principal objects of the invention is to provide an improved sumping continuous miner that provides better support to the miner when the cutting drum is sumping forward.

This invention is a continuous miner including a support frame having a support frame front, and a sumping frame mounted on the support frame for forward and rearward movement relative to the support frame. The sumping frame has a sumping frame front, and the miner further includes a cutting drum pivotally mounted on the sumping frame, the cutting drum being positioned near the sumping frame front. The miner also includes a gathering head for gathering mined minerals pivotally mounted on the sumping frame front, and a hydraulic cylinder for pivoting and fixing the gathering head relative to the sumping frame in both the raising and lowering directions. The continuous miner also includes a first drilling platform pivotally mounted on the support frame front, a second drilling platform pivotally mounted on the support frame front and spaced apart from the first drilling platform, a hydraulic cylinder for pivoting and fixing the first drilling platform relative to the support frame independently of the second drilling platform, and a hydraulic cylinder for pivoting and fixing the second drilling platform relative to the support frame independently of the first drilling platform.

Figure 1:
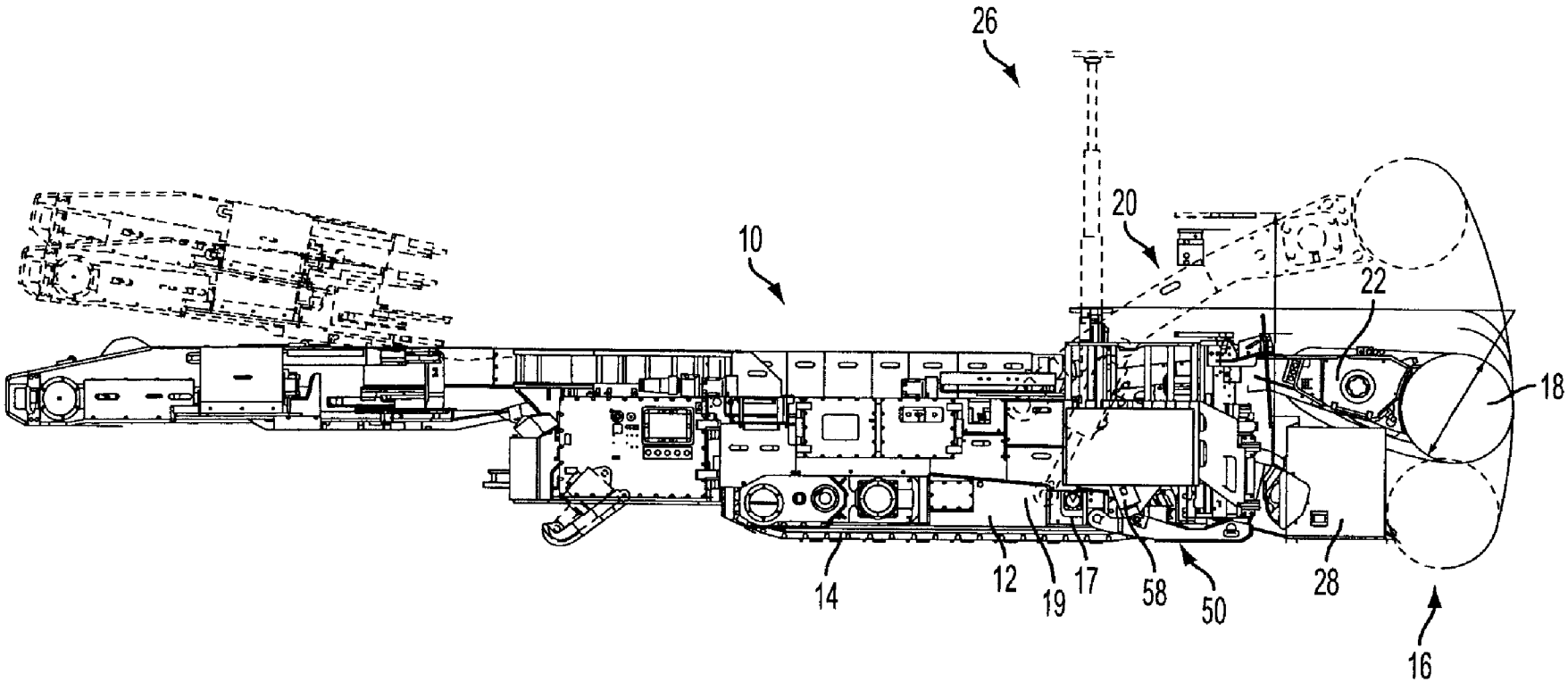
FIG. 1 is a side view of the continuous mining machine of this invention. A boom having a cutter drum mounted on the end of the boom is shown in various cutting positions.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENT

As illustrated in FIG. 1 of the drawings, the invention 10 is a mobile underground mining apparatus commonly referred to as a continuous miner.

The continuous miner 10 includes a mobile crawler base 14 carrying a support frame 12 on which is pivotally mounted adjacent the forward end or sumping frame front 19 thereof a sumping frame or assembly 20 including a forwardly extending boom 22 pivotally connected to the sumping frame 20 and adapted to swing vertically intermediate a mine roof 26 and a floor 16. The sumping frame 20 is mounted on the support frame 12 for forward and rearward movement relative to the support frame 12. More particularly, the support frame 12 has a support frame front 17. The miner 10 also includes gathering means 28 for gathering mined minerals, the gathering means 28 being pivotally mounted on the sumping frame front 19, as further explained below.

The miner 10 also includes a cutting drum 18 attached to the end of the boom 22, and the cutting drum 18 is positioned near the sumping frame front 19. The cutting drum shown schematically at 18 may assume any of numerous well known forms such as a transversely extending cylindrical drum rotatably secured adjacent the forward most end of boom 22. A driving motor (not shown) is connected to the drum 18 as by a suitable drive train (not shown) to power the drum 18 in rotation whereby suitable cutter bit members (not shown) carried thereon are adapted to tear or gouge coal or other minerals from a mine face (not shown) as the head 18 is advanced into the mine face during mining.

More particularly, the gathering means for gathering mined minerals is a well-known gathering head 28. The gathering head 28 is pivotally carried adjacent the forward end 19 of the support frame 12, and extends forwardly there from generally adjacent the support boom 22 to gather the coal dislodged by the cutting drum 18. The gathering head 28 moves the minerals, such as coal, inwardly and rearwardly as by means of oscillating gathering arms (not shown) and a flighted chain conveyor 32 toward a well known loading boom 34 also carried by the sumping frame 20 adjacent the rearward end thereof and extending rearwardly there from. Boom 34 includes thereon any suitable powered conveying means (not shown) such as a flighted chain conveyor similar to the conveyor 32 for conveying coal received from the gathering head 28 rearwardly into any suitable hauling means (not shown) such as shuttle cars or the like.

Figure 3:
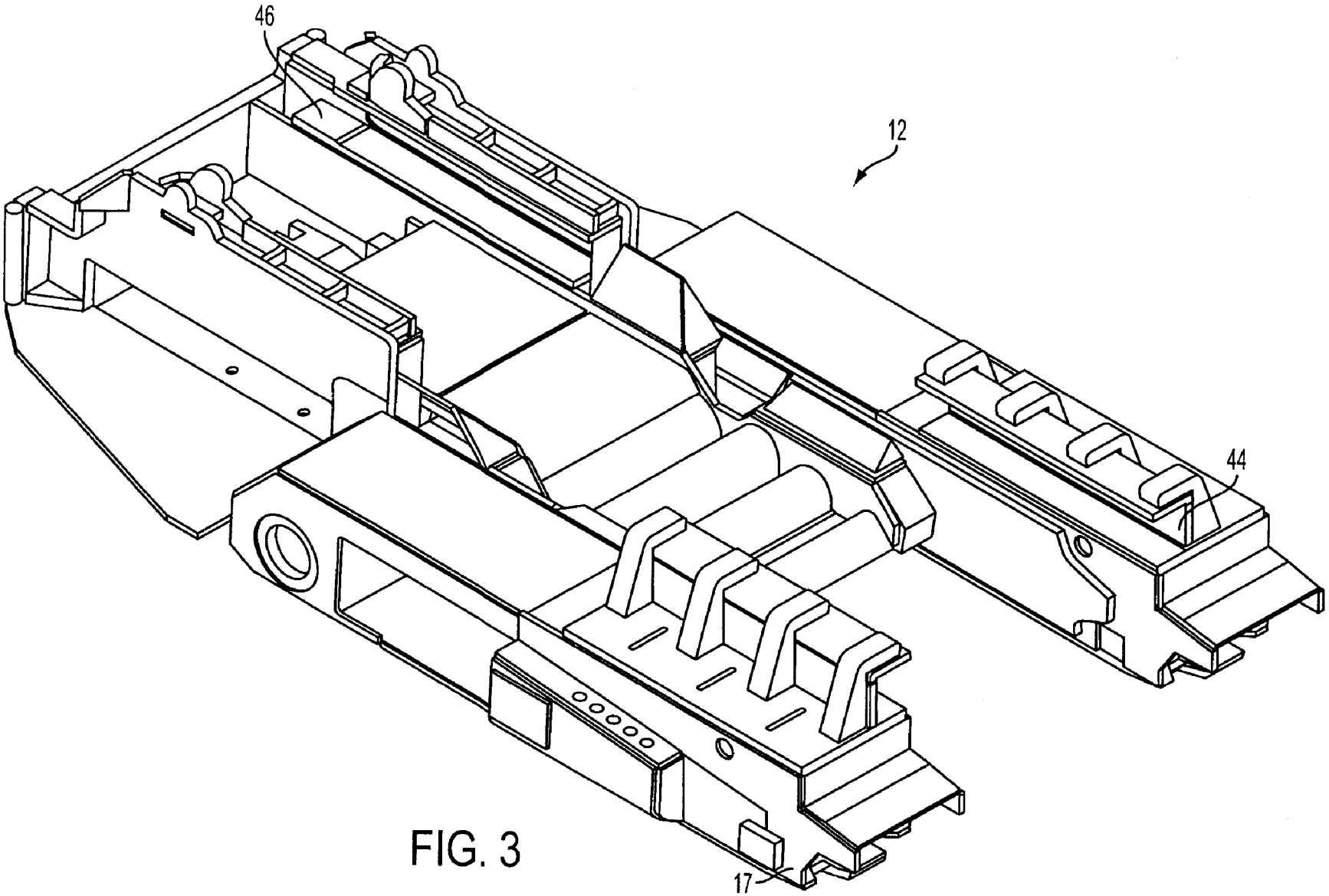
FIG. 3 is a perspective view of the support frame of the continuous miner of the invention.
Figure 4:
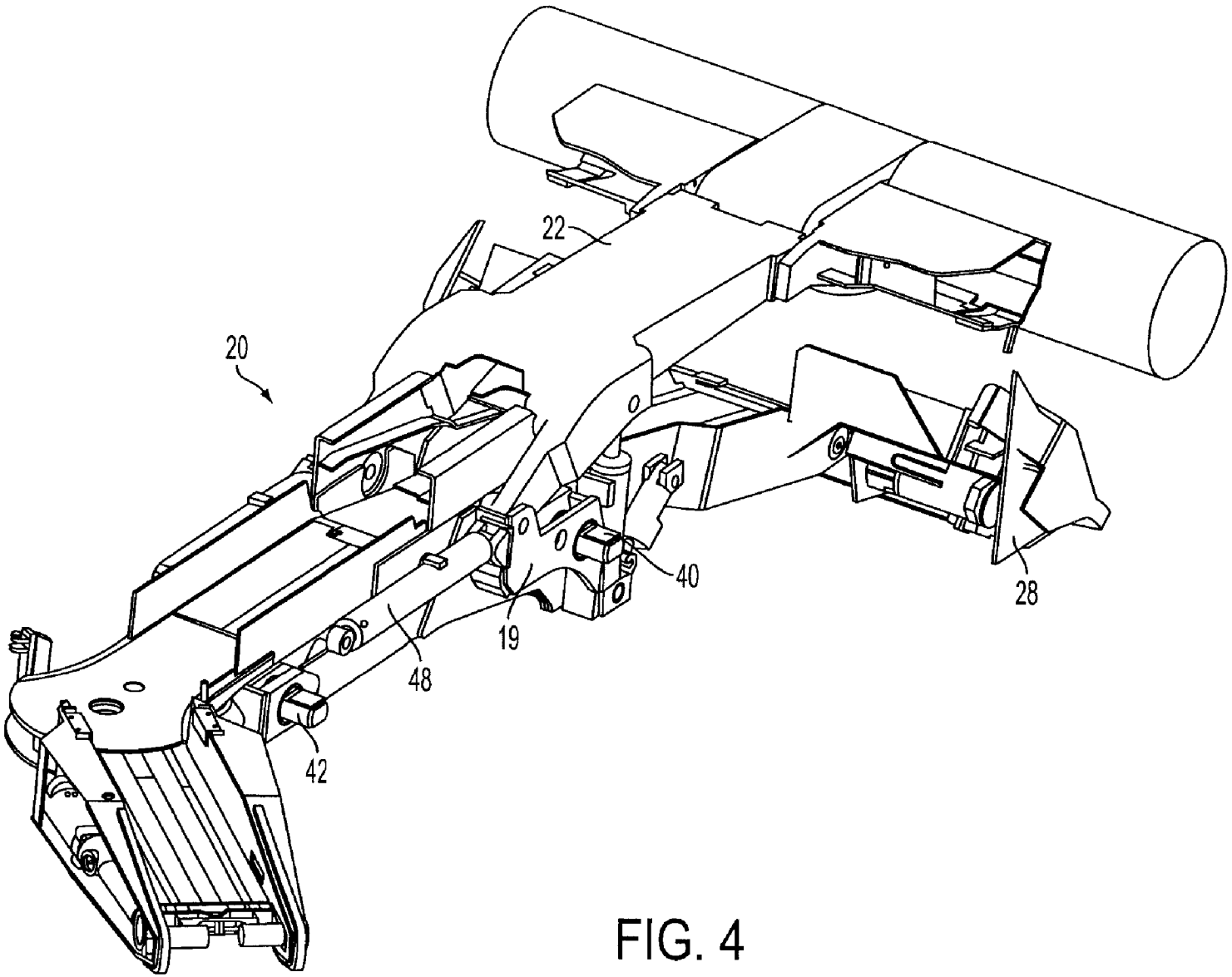
FIG. 4 is a perspective view of the sumping frame assembly of the continuous miner of the invention.

Still more particularly, the sumping frame 20 is mounted on the support frame 12 as follows. As illustrated in FIG. 4, the sumping frame 20 includes a forward sliding pin 40, and a rearward sliding pin 42. As illustrated in FIG. 3, the support frame 12 includes forward channels 44 that receive the forward sliding pins 40, and rear channels 46 that receive the rearward sliding pins 42. The sumping frame 20 is caused to move relative to the support frame 12 by the extension or retraction of a hydraulic cylinder 48 (see FIG. 4) connected between the sumping frame 20 and the support frame 12. More particularly, there are a pair of such hydraulic cylinders 48 (only one is shown) on each side of the sumping frame 20.

Figure 2:
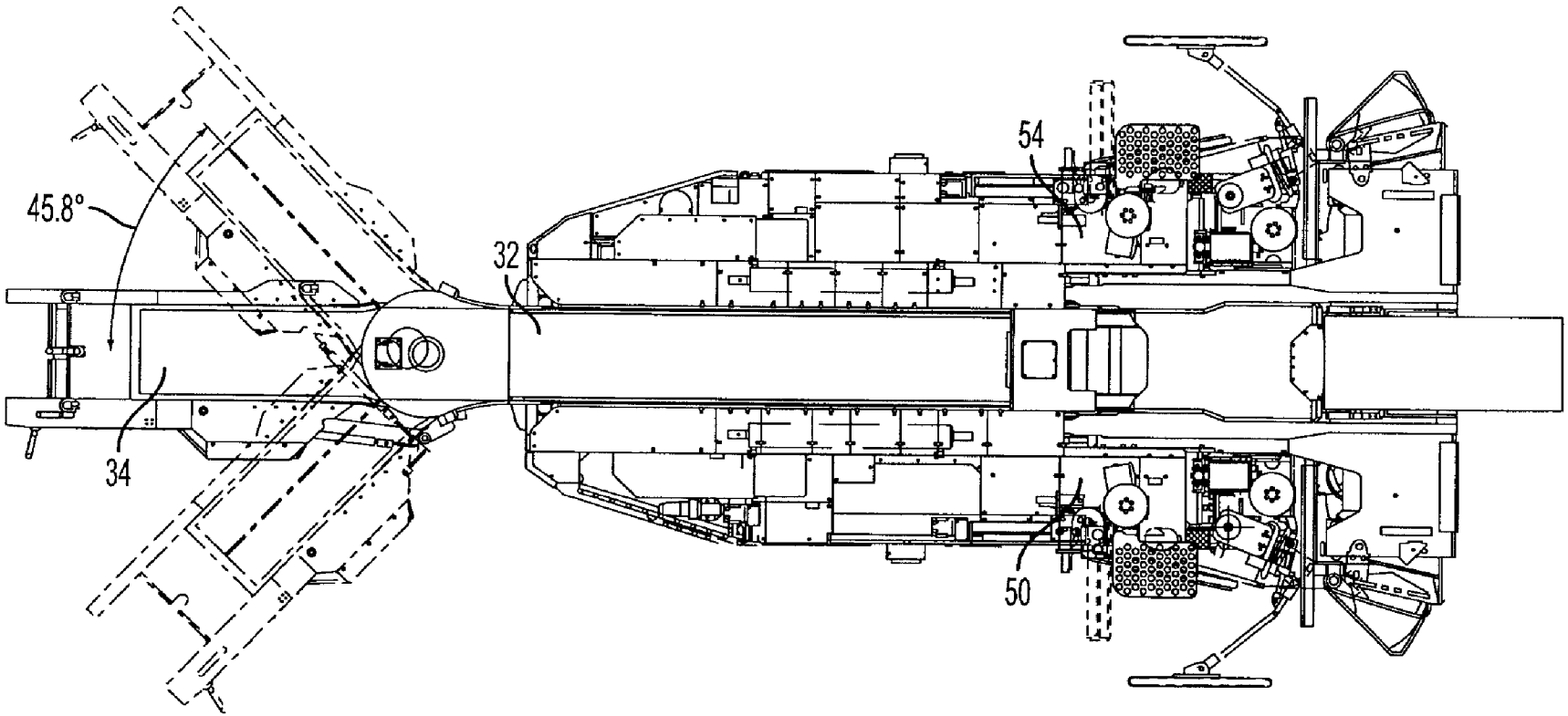
FIG. 2 is a top view of the continuous miner of this invention, with the cutting drum removed. At the right end of the machine, the sumped position of the gathering head is shown in ghost. At the left end, the discharge conveyor is shown in various positions.
Figure 5:
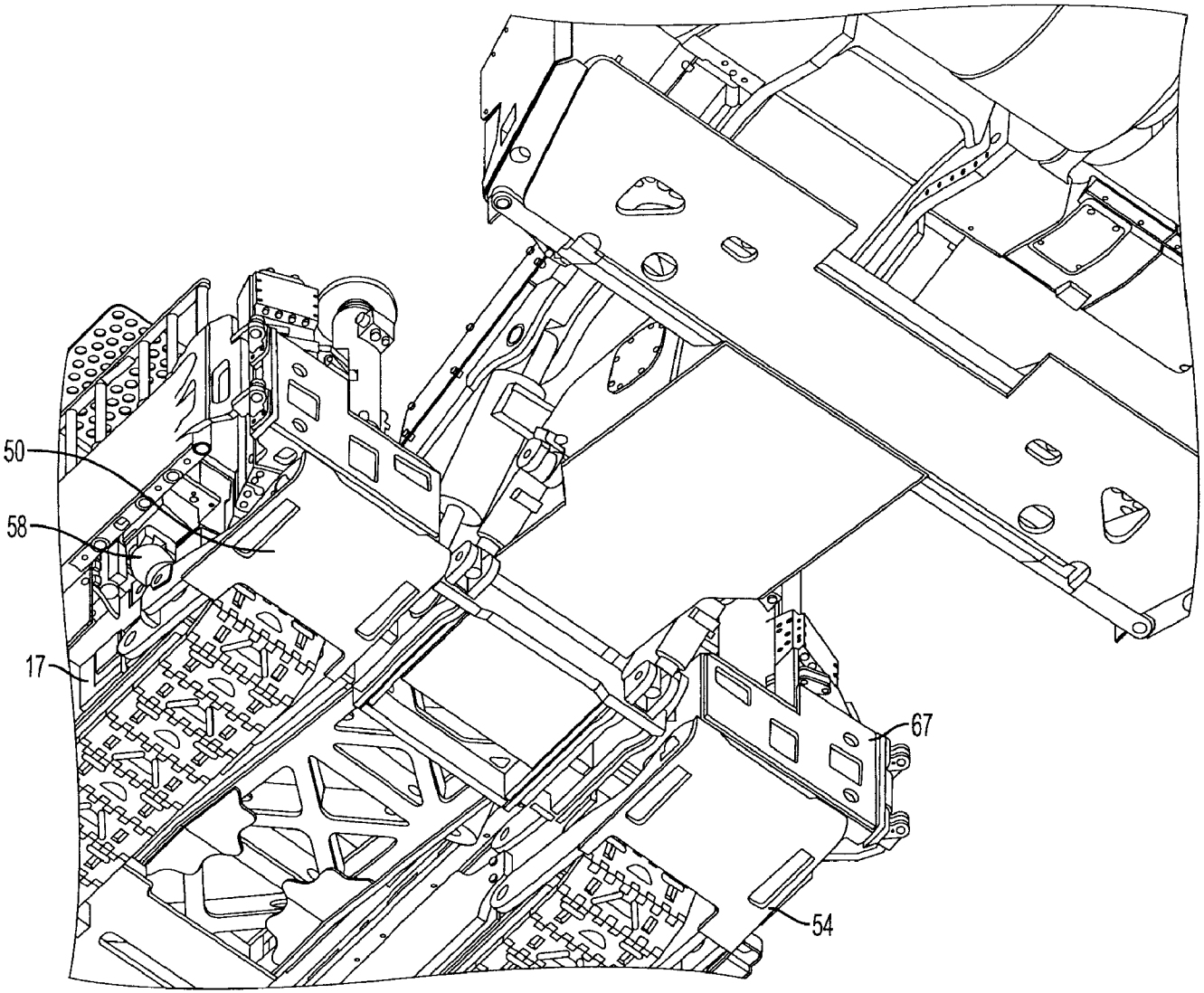
FIG. 5 is a partial perspective view of the bottom of the continuous miner.

As best shown in FIG. 5, the continuous miner 10 also includes a first drilling platform 50 pivotally mounted on the support frame front 17, a second drilling platform 54 pivotally mounted on the support frame front and spaced apart from the first drilling platform 50 (see FIGS. 2 and 5), means 58 for pivoting and fixing the first drilling platform 50 relative to the support frame independently of the second drilling platform, and means 62 (see FIG. 8) for pivoting and fixing the second drilling platform 54 relative to the support frame 12 independently of the first drilling platform 50.

Figure 6:
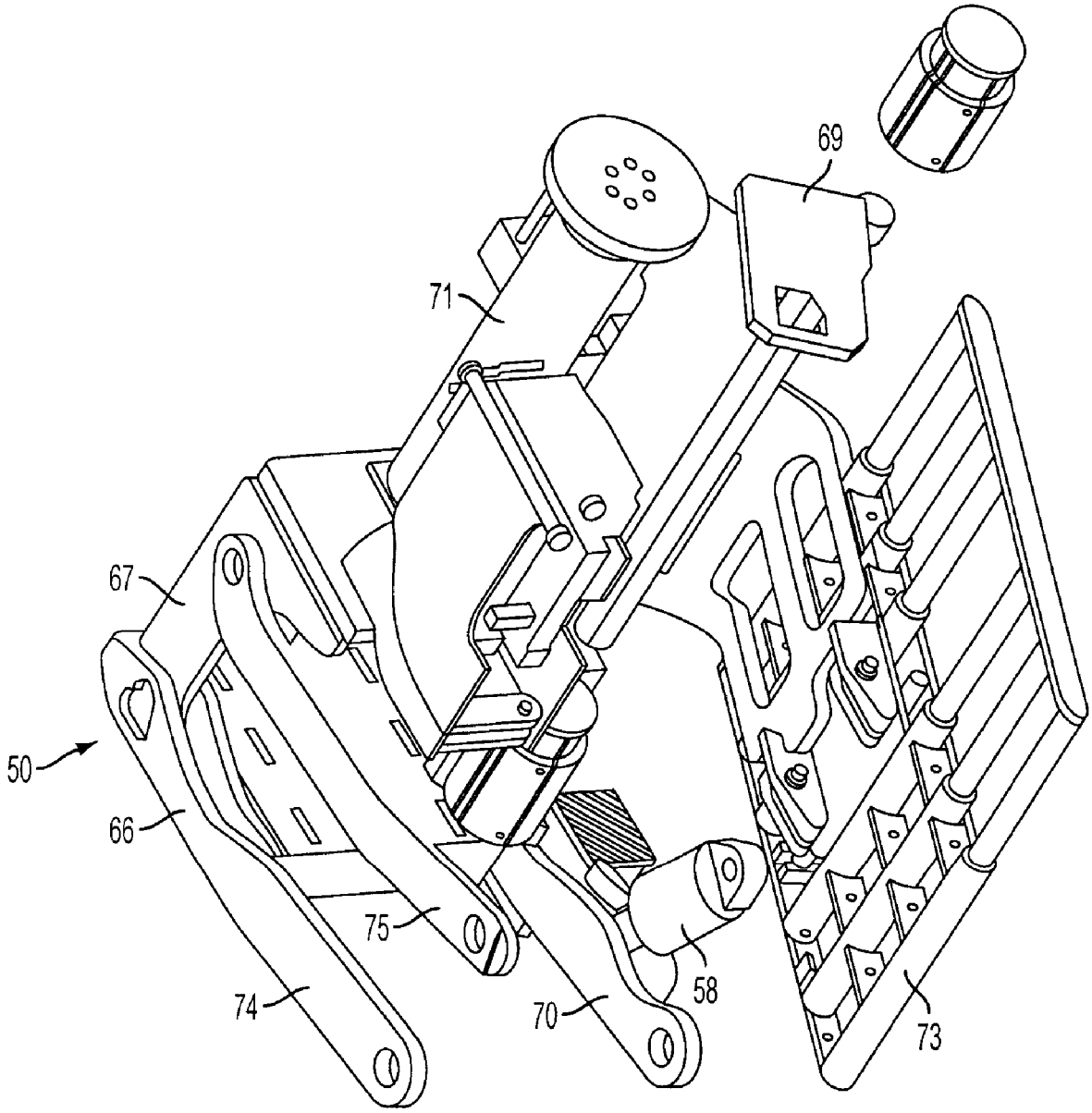
FIG. 6 is a perspective view of the rightmost drill platform as shown in FIG. 2.
Figure 7:
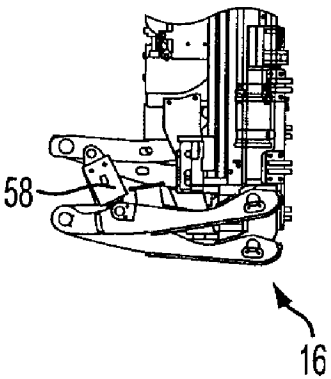
FIG. 7 is a side view, when looking at the top of the mining machine in FIG. 4, of the rightmost drilling platform shown in the raised position and the leftmost drilling platform shown in the lowered position.

More particularly, as best shown in FIG. 6, the first and second drilling platforms each include a support plate 66, and each of the drilling platforms is pivotally mounted on the support frame front 17 by each drilling platform including a first pivot arm 70 on one side of the support plate and a second pivot arm 74 on the other side of the support plate. Each of the means 58 and 62 for pivoting and fixing the drilling platform is in the form of a hydraulic cylinder extending between the support frame front 17 and the respective drilling platform. A front shield 67 (see FIGS. 5 and 6) extends from the forward edge of each support plate 66, and a third pivot arm 75 on the inboard side of the drilling platform above and spaced apart from the second pivot arm 74 is pivotally connected between the support frame front 17 and the front shield 67 to further aid in maintaining the drilling platform in an upright position when the drilling platform is located above the mine floor. A drill 69 and a temporary roof support 71 are also mounted on the front shield 67. An operator's shield 73 is also attached to the outboard side of the front shield 67.

Figure 8:
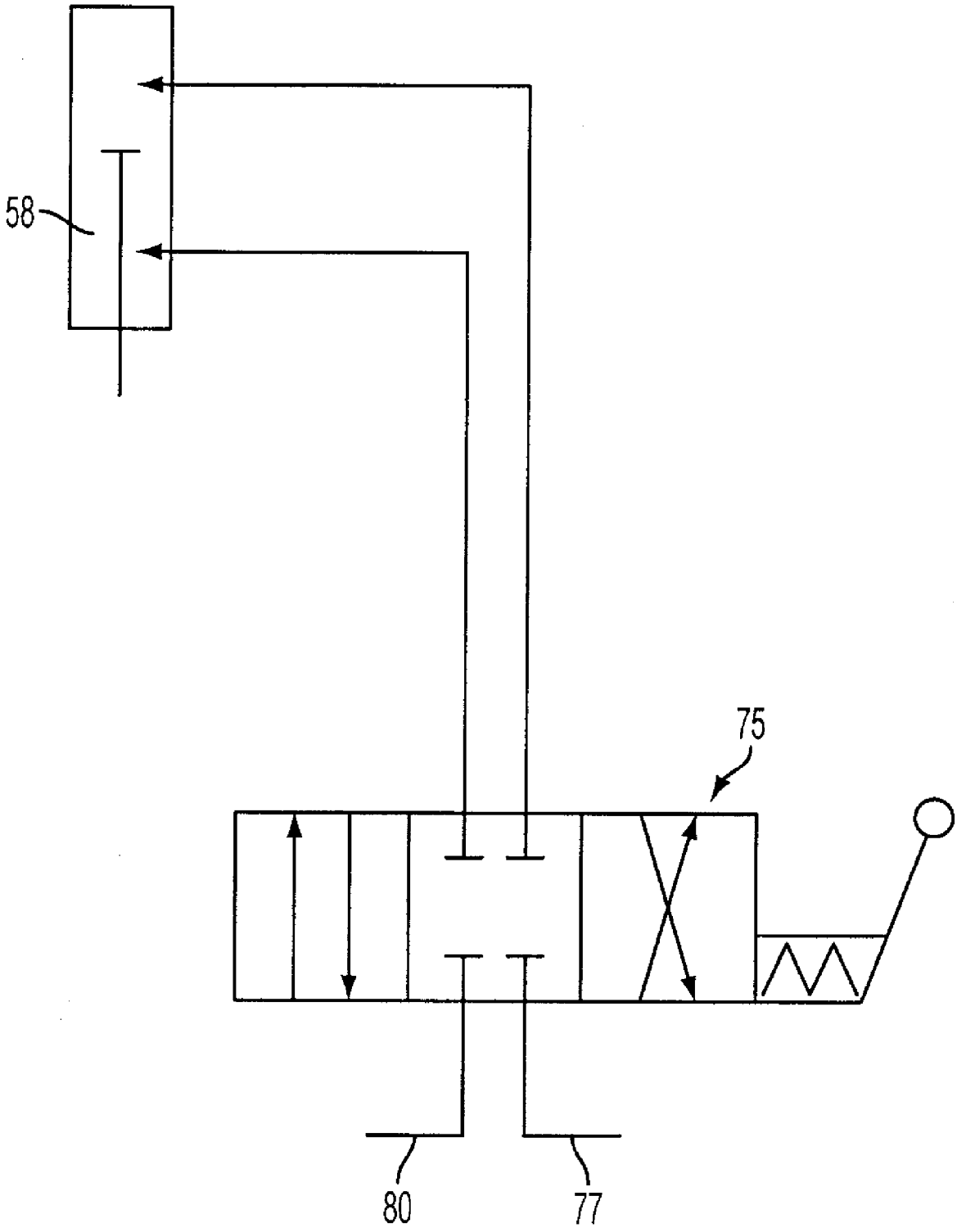
FIG. 8 is a schematic view of the connection of hydraulic cylinders that extend between the drilling platforms and the support frame.

As shown schematically in FIG. 8, each of the cylinders 58 and 62 (only cylinder 58 is shown) is independently connected through its own respective directional control valve 75 to a high pressure line 77, for independently extending the respective hydraulic cylinder, and a low pressure line 80 for retracting the respective hydraulic cylinder. Thus the respective valves for the respective cylinders permit each drilling platform to be fixed independently in a particular position. This has the advantage of providing further structural stability, as needed on either side of the support frame 12, when the sumping frame 20 is slide forward along the support frame 12. This arrangement also has the advantage of providing assistance in positioning the continuous miner 10 in correct vertical orientation to the mined face.

The miner 10 also includes means 82 for pivoting and fixing the gathering means relative to the sumping frame in both the raising and lowering directions. More particularly, the means 82 for pivoting and fixing the gathering means includes a hydraulic cylinder 86 extending between the frame front and the gathering head. And still more particularly, two spaced apart hydraulic cylinders 86 extend between the sumping frame front and the means for gathering mined minerals, and each cylinder 86 is on an opposite side of the gathering head. A valve arrangement similar to that shown in regards to the hydraulic cylinders 58 and 62 is used to fix the gathering head 28 in a particular position. A significant difference however is that the two cylinders 86 are operated in unison by a single directional control valve, as opposed to independently like the cylinders 58 and 62. This has the advantage of providing further structural stability to the continuous miner 10 when the sumping frame 20 is slid forward along the support frame 12.

Various other features and advantages of the invention will be apparent from the following claims.

The invention claimed is:

1. A continuous miner including a horizontal support frame having a support frame front, a sumping frame mounted on said support frame for forward and rearward movement relative to said support frame, said sumping frame having a sumping frame front, a cutting drum pivotally mounted on the sumping frame, said cutting drum being positioned near said sumping frame front, gathering means for gathering mined minerals pivotally mounted on the sumping frame front, means for pivoting and fixing said gathering means relative to said sumping frame in both the raising and lowering directions, a first drilling platform pivotally mounted for vertical movement on the support frame front, a second drilling platform pivotally mounted for vertical movement on the support frame front and spaced apart from the first drilling platform, means for pivoting and fixing said first drilling platform relative to said support frame independently of said second drilling platform, and means for pivoting and fixing said second drilling platform relative to said support frame independently of said first drilling platform.

2. A continuous miner in accordance with claim 1 wherein said first and second drilling platforms each include a support plate, and wherein each of said drilling platforms is pivotally mounted for vertical movement on said support frame front by each drilling platform including a first pivot arm on one side of said support plate and a second pivot arm on the other side of said support plate, and wherein each of said means for pivoting and fixing said drilling platform includes a hydraulic cylinder extending between said frame front and said drilling platform.

3. A continuous miner in accordance with claim 1 wherein said means for pivoting and fixing said gathering means includes a hydraulic cylinder extending between said frame front and said gathering head.

4. A continuous miner in accordance with claim 1 wherein said means for pivoting and fixing said gathering means includes two spaced apart hydraulic cylinders extending between said sumping frame front and said means for gathering mined minerals, each cylinder being on an opposite side of said gathering means.

5. A continuous miner in accordance with claim 1 wherein said gathering means is a gathering head.

* * * * *